United States Patent [19]

Larson

[11] Patent Number: 4,856,435

[45] Date of Patent: Aug. 15, 1989

[54] STOWABLE WORK BENCH

[76] Inventor: Kevin D. Larson, 3032 Sawdust La., Dublin, Ohio 43017

[21] Appl. No.: 199,167

[22] Filed: May 26, 1988

[51] Int. Cl.[4] ..... A47C 5/04

[52] U.S. Cl. ..... 108/134; 108/48

[58] Field of Search ..... 108/134, 43, 48, 47

[56] References Cited

U.S. PATENT DOCUMENTS

| | | | |
|---|---|---|---|
| 279,290 | 6/1883 | Von Derwulbeke | 108/48 |
| 969,684 | 9/1910 | Cline | 108/48 |
| 1,082,082 | 12/1913 | Jiranek . | |
| 1,284,512 | 11/1918 | Werner | 108/134 |
| 1,724,457 | 8/1929 | Cummings | 108/134 X |
| 2,616,774 | 11/1952 | Prince | 108/48 X |
| 3,080,832 | 3/1963 | Schroemges | 108/134 X |
| 3,394,666 | 7/1968 | Pearlman . | |
| 3,709,159 | 1/1973 | Oglesby . | |
| 4,068,551 | 1/1978 | Kreitz | 108/48 X |
| 4,155,609 | 5/1979 | Skafte et al. | 108/48 X |
| 4,313,385 | 2/1982 | Fitzgerald | 108/48 X |
| 4,375,306 | 3/1983 | Linder . | |
| 4,404,915 | 9/1983 | Simpson . | |
| 4,489,661 | 12/1984 | Fitzgerald . | |

*Primary Examiner*—Peter A. Aschenbrenner

*Attorney, Agent, or Firm*—Thomas S. Baker, Jr.

[57] ABSTRACT

A stowable workbench adapted to be mounted on a tool box having a flat work surface movable between a working position in which it extends laterally from the work bench and a stowage position in which it extends perpendicular to the workbench.

1 Claim, 1 Drawing Sheet

STOWABLE WORK BENCH

BACKGROUND OF THE INVENTION

Service people who utilize tools and equipment in their work commonly store such tools and equipment in some type of tool box. This tool box may have a plurality of compartments and drawers, may be mounted on wheels and may have a plurality of stackable sections. Large tool boxes typically are mounted on some type of rollers for ease of transport. Additionally, some tool boxes have a pull down cover which may be moved between a storage position in which free access may be had to the drawers and compartments of the tool box and a locked position in which it overlies the drawers and compartments of the tool box to prevent access thereto.

In many instances a service person must move his tool box from a fixed bench or location to a location in close proximity to the equipment being serviced. Tool boxes on rollers may be pushed or pulled to the work location without being lifted. A problem frequently encountered by a service person working at a remote location or at a location away from a fixed bench or counter resides in the fact that there is no place other than the ground to place tools or parts that are being worked with. In order to prevent a loss of parts or equipment a service person may have to lay a piece of cardboard, plastic sheet, paper or some such material on the ground in close proximity to the work place. Finding a clean piece of suitable material may be difficult and at the least is time consuming and inconvenient. In some instances a service person may elect to temporarily construct some type of work bench adjacent to his work area, however, this too is time consuming and inconvenient.

Accordingly, it has been found desirable to provide a stowable work bench which may be integrated into the structure of a movable tool box.

SUMMARY OF THE INVENTION

A stowable work bench adapted to be pivotally affixed to one side of a movable tool box includes a generally flat work surface that is pivotally mounted to one side of the tool box. The flat work surface may be moved between a working position in which the work surface lies in a generally horizontal plane such that it extends outwardly from the side of the tool box and a stowed position in which the work surface attains in a generally vertical orientation such that it extends parallel to the side of the tool box. A movable support extends between the other end of the work surface and the ground, such support being movable between a first position in which it extends perpendicular to the work surface when that surface is in a working position and a second position in which it extends parallel to the work surface when that surface is in a stowed position.

DESCRIPTION OF THE PREFERRED EMBODIMENT

Figure 1:
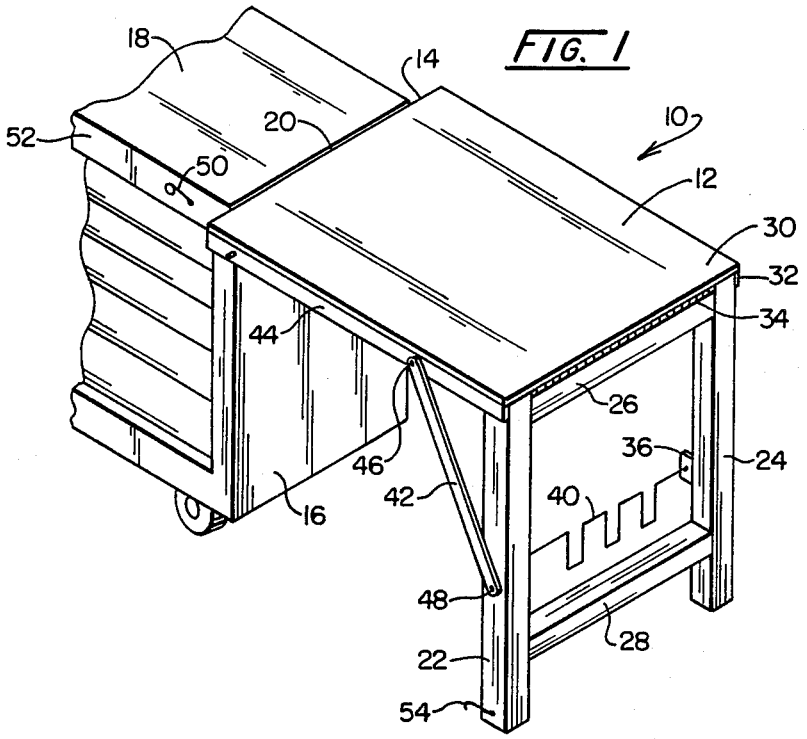
FIG. 1 is a prospective view of the stowable work bench of the present invention affixed to a movable tool box.

Referring to FIG. 1, it may be seen that the stowable workbench 10 includes a flat work surface 12 which has one lateral edge 14 pivotally affixed to a side 16 of a tool box 18 by a hinge 20. A support means comprising a pair of legs 22 and 24 which are rigidly connected together by an upper lateral brace 26 and a lower lateral brace 28 supports the end 30 of flat work surface 12 remote from the tool box 18. The support means is connected to the lateral edge 32 of work surface 12 by means of a hinge 34 that is connected between the upper lateral brace 26 and the lateral edge 32.

Figure 2:
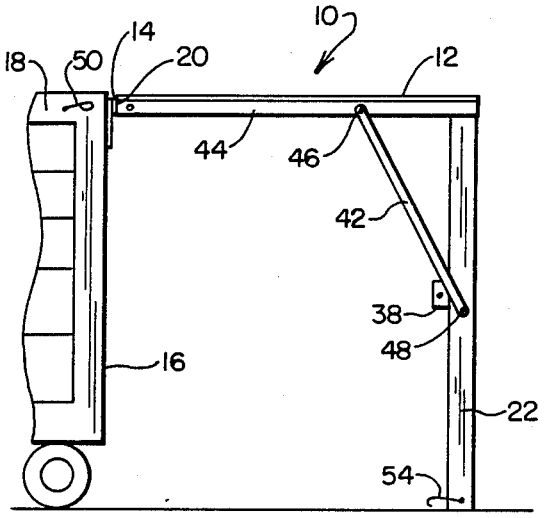
FIG. 2 is a front side view of the stowable work bench in the working position.

A pair of brackets 36 and 38 optionally may be affixed to legs 22 and 24 such that they project inwardly towards side 16 of tool box 18. Preferably, a laterally extending hanger 40 is mounted pivotally within the brackets 36 and 38 to provide a mounting and storage place for tools such as air or hydraulic connectors or fittings, large wrenches, etc. A locking arm 42 has one end pivotally connected to one longitudinal edge 44 of work surface 12 and the opposite end adapted to be rigidly connected to leg 22 by a locking means such as a bolt 48 to thereby maintain the support means in a vertical position with respect to work surface 12 when the work surface is in the working position illustrated in FIGS. 1 and 2. Bolt 48 may be removed to permit the locking arm 42 to pivot to a position in which the opposite end of the arm is rigidly affixed to longitudinal edge 44 and parallel thereto when the flat work surface 12 is in the stowed position and the support means extends parallel to that surface as illustrated in FIG. 3.

Turning again to FIG. 3, it may be observed that in order to stow the work bench 10 the flat work surface 12 is pivoted downwardly or clockwise about the axis of hinge 20 such that it assumes a position parallel to the side 16 of tool box 18 and simultaneously the support means including legs and 22 and 24 is pivoted upwardly or counter clockwise about the axis of hinge 34 such that the legs 22 and 24 assume a position parallel to the side 16 of tool box 18 and the flat work surface 12 and thereby sandwich the work surface 12 between the side 16 of tool box 18 and the legs 22 and 24.

Figure 3:
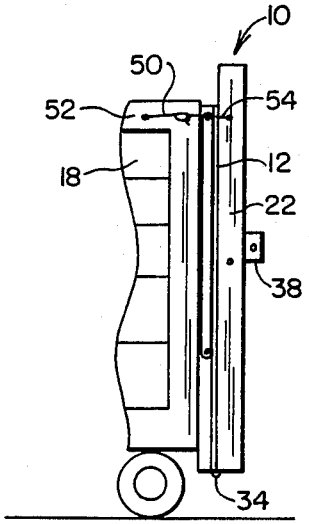
FIG. 3 is a side view of the stowable work bench in the stowed position.

The flat work surface 12 is retained in the stowed position illustrated in FIG. 3 by means of a locking device comprising a hook 50 affixed to one longitudinal edge 52 of work bench 18 which engages an eye 54 mounted toward the bottom of leg 22.

Referring to FIG. 3, it may be observed that the brackets 36 and 38 which mount the hanger 40 project outwardly of the legs 22 and 24 when the legs are in the stowed position. In this way tools mounted on hanger 40 do not touch the flat work surface 12 when that surface has been placed in the stowed position.

From the above, it may be seen that the stowable work bench of the present invention comprises a flat work surface which in the working position provided a convenient place for setting tools and parts and that the work surface may easily be moved to a stowed position in which it lies parallel to the side of the work bench and extends a laterally a minimum distance therefrom.

Since certain changes may be made in the above-described system and apparatus without departing from the scope of the invention herein, it is intended that all matter contained in the description and shown in the accompanying drawings shall be interpreted as illustrative and not in a limiting sense.

I claim:

1. A stowable work bench adapted to be pivotally mounted to one side of a tool box comprising:

a generally flat work surface having a top side and a bottom side;

first pivot means attached to one end of said work surface for pivotally mounting said work bench to one side of a tool box;

wherein said flat work surface is moveable between a working position in which said work surface lies in a generally horizontal plane such that it extends outwardly from said first pivot means and said top side faces upwardly and a stowed position in which said work surface lies in a generally vertical plane such that it extends downwardly from said first pivot means and said top side faces outwardly;

a movable support means for said work surface;

second pivot means attached to said movable support means and the other end of said work surface to provide a pivotal connection therebetween; and wherein said support means is movable between a first position in which it extends downwardly from said bottom side perpendicular to said work surface to engage the ground when said surface is in said working position and a second position in which it extends parallel to said work surface and overlies said top side when said work surface is in said stowed position.

* * * * *